US007540564B2

(12) United States Patent
Gokhale

(10) Patent No.: US 7,540,564 B2
(45) Date of Patent: Jun. 2, 2009

(54) ERGONOMIC SYSTEMS AND DEVICES

(75) Inventor: Esther Gokhale, 881 Tolman Dr., Stanford, CA (US) 94305

(73) Assignee: Esther Gokhale, Stanford, CA (US)

( * ) Notice: Subject to any disclaimer, the term of this patent is extended or adjusted under 35 U.S.C. 154(b) by 3 days.

(21) Appl. No.: 11/731,699

(22) Filed: Mar. 29, 2007

(65) Prior Publication Data

US 2007/0228791 A1 Oct. 4, 2007

Related U.S. Application Data

(60) Provisional application No. 60/787,866, filed on Mar. 30, 2006, provisional application No. 60/927,044, filed on Mar. 21, 2007.

(51) Int. Cl.
*A47C 7/02* (2006.01)
*A47C 7/46* (2006.01)

(52) U.S. Cl. ..... 297/230.14; 297/284.1; 297/284.4; 297/284.7

(58) Field of Classification Search ..... 297/230.14, 297/284.1, 284.4, 284.5, 284.7; 5/630, 632, 5/633, 944
See application file for complete search history.

(56) References Cited

U.S. PATENT DOCUMENTS 1,007,985 A * 11/1911 Smith ..... 297/284.7
4,676,550 A * 6/1987 Neve De Mevergnies ... 297/353
5,027,795 A * 7/1991 Kato ..... 601/15
5,481,771 A * 1/1996 Burk, IV ..... 5/636
6,260,921 B1 * 7/2001 Chu et al. ..... 297/284.4
6,305,040 B1 * 10/2001 Myler ..... 5/636
6,364,414 B1 * 4/2002 Specht ..... 297/410
6,807,696 B2 * 10/2004 Magistretti ..... 5/633
6,921,372 B2 * 7/2005 Shin ..... 601/134
2002/0130541 A1 * 9/2002 Koo ..... 297/284.7
2005/0125901 A1 * 6/2005 Nichols ..... 5/636

FOREIGN PATENT DOCUMENTS

GB 2107576 A * 5/1983

* cited by examiner

*Primary Examiner*—Sarah B McPartlin
(74) *Attorney, Agent, or Firm*—James A. Gavney

(57) ABSTRACT

Ergonomic systems and devices are disclosed. In accordance with the embodiments of the invention, a system or device includes a traction surface that provides traction and/or support through contact with a portion of a user's body. For example, an ergonomic system includes a backrest cushion. The backrest cushion has a traction surface with a plurality of protruding traction pads for resting against a user's back and pulling along the user's back. The traction pads help stretch or decompress the user's spine through contact at multiple positions on the back and flanking the spine. In alternative embodiments of the invention, a chair, resting table, bed or other article of furniture includes one or more traction surfaces that provide traction through contact with one or more corresponding portions of a user's body.

18 Claims, 6 Drawing Sheets

ERGONOMIC SYSTEMS AND DEVICES

RELATED APPLICATIONS

This application claims priority under 35 U.S.C. § 119(e) from the Co-pending U.S. Provisional Patent Application Ser. No. 60/787,866, filed on Mar. 30, 2006, and titled "ERGONOMIC SYSTEMS AND DEVICES" and the Co-pending U.S. Provisional Patent Application Ser. No. 60/927,044, filed on Mar. 21, 2007, and titled "METHODS FOR REDUCING BACK-PAIN," both of which are hereby incorporated by reference.

FIELD OF THE INVENTION

This invention relates generally to ergonomic systems and devices. More specifically, this invention relates to ergonomic systems and devices for improving the posture, comfort and well being of individuals through traction, support and/or motion.

BACKGROUND OF THE INVENTION

Most people spend many hours sitting, during commutes, work, and leisure time. The way they sit and the long hours of sitting compromise their discs and other spinal elements, contributing to degenerative disc disease and the formation of osteophytes, muscular tension, and other pathological conditions.

The traditional approaches to mitigate the above referenced conditions include lumbar support devices. Lumbar support devices are typically configured to conform to what is considered to be a "normal" lumbar or spinal curvature. It is possible that the contemporary notions of "normal" lumbar or spinal curvature are of an average curvature measured in the current (and back-pain ridden) population.

Finding an "ideal" spinal curvature, rather than the "normal" spinal curvatures, may require studies of populations with healthy backs in different times and cultures. Current results for such a study indicate that the "ideal" spinal shape has less curvature than the S-shaped spinal shape traditionally thought to be the "ideal" spinal shape.

Regardless of what the ideal spinal shape is, there is clearly a need for ergonomic systems and devices that help people maintain good postures and reduce discomfort or ailments that are associated with poor posture, positioning and/or support.

SUMMARY OF THE INVENTION

The present invention is directed to an apparatus that includes a cushion structure. The cushion structure has a plurality of protruding traction pads that protrude from and are attached to a cushion body. The cushion body can include a cover and a padding structure.

The protruding traction pads are preferably arranged in rows along the cushion body, such that the protruding traction pads are positioned along opposed sides of a user's spine when the user rests his or her back against the cushion structure. The protruding traction pads provide an upward force along the opposed sides of the user's spine and thus help to promote good posture.

The cushion structure can be formed from any suitable material or combination of materials, but the protruding traction pads are preferably formed from a semi-rigid material, such as a plastic or a rubber material. The traction pads can be hollow or cup-shaped structures that provide an air cushion, they can be filled with a liquid or gel to control hardness or compressibility, and they can be solid or porous structures or any combination thereof. Also, contact surfaces of the traction pads can be patterned or contoured to enhance traction when contacted with a user's back. Regardless of the particular structure of the traction pads, what is important is that the traction pads help prevent the user's back from sliding downward or slouching while he or she is leaning against the cushion structure.

The cover of the cushion structure can be formed from any suitable material or combination of materials including synthetic or natural materials. Preferably, the cover is formed from a woven material, such as nylon, cotton, wool and the like. In accordance with the embodiments of the invention, the cover is used to encase the padding structure. The padding structure can be formed from any suitable compressible material or combination of materials, such as a foam material, a batting material, or un-woven cotton. The padding structure can also be formed in layers or have regions of different materials that each has different physical properties, such as hardness and compressibility. The cover can be fashioned with a zipper or other features that allow the padding structure to be separated from the cover. It will be clear to one skilled in the art from the discussion below that the cushion body does not require a separate cover and padding structure and that the cushion body and traction pads can be formed as a single unit or monolithic unit.

In accordance with further embodiments of the invention, the cushion apparatus includes an attachment feature to detachably couple the cushion structure to an article of furniture at a location against which a user typically rests his or her back. For example, the cushion apparatus of the present invention includes an attachment feature for detachably coupling the cushion structure to a backrest of a chair, the backrest of a couch and/or a headboard of a bed. The attachment feature can be any suitable attachment feature or combination of attachment features including, but not limited to, one or more strap features, a pocket feature, a strap feature, a hook-and-loop fabric feature, a suction cup feature and a clip feature.

In accordance with the embodiments of the invention, the apparatus includes a back support structure and a cushion structure, such as described above. The back support structure can be configured to attached to a seat, chair or other article of furniture. In accordance with this embodiment, the apparatus can also include a mechanism configured to move the cushion structure a distance in a first direction relative to the back support structure in response to moving the back support in a second direction or in response to moving a lever mechanism.

The apparatus can also include a control feature that allows the distance that the cushion structure is moved relative to the back support structure to be adjusted or selected. In accordance with one embodiment of the invention, the cushion structure is moved in the first direction relative to the back support structure through a ratchet mechanism.

In accordance with yet further embodiments of the invention, an article of furniture includes a built-in ergonomic back support system, similar to that described above. The article of furniture is, for example, a chair for home or office use and includes a seat portion and a backrest portion. Attached to or built into the backrest portion is a cushion structure that is coupled to a mechanism. The mechanism is preferably a ratchet mechanism configured to move the cushion structure in an upward direction relative to the seat when the backrest is moved with a reclining motion relative to the seat. Alternatively, the chair is equipped with a lever structure that can be pulled to move the cushion structure, such as described above. The ratchet mechanism can include pulleys, clutch-pulleys and cables, such as described in detail below.

The built-in ergonomic back support system includes a cushion structure with a plurality of protruding traction pads for providing a force along opposed sides of a user's spine as the user's back is in contact with the cushion structure, such as described above. In accordance with the embodiments of the invention, the cushion structure is fashioned into a belt that rotates around two or more rollers or pulleys to move a portion of the cushion structure in an upward direction a distance along the backrest. The belt is coupled to the ratchet mechanism, such that the belt or cushion structure is moved in the upward direction the distance along the backrest each time that the backrest is moved in the reclining direction relative to the seat. In still further embodiments of the invention, the traction pads and/or a cushion cover with the traction pads is detachably coupled to the belt, through, for example, snaps, clips, hook-and-loop fabric fasteners or any other suitable attachment means.

The article of furniture can further include any number of controls or adjustment features. For example, the article of furniture can be equipped with a control to adjust the distance that the cushion structure is moved in the upward direction along the backrest each time that the backrest is moved in the reclining direction.

DETAILED DESCRIPTION OF THE INVENTION

Figure 1A:
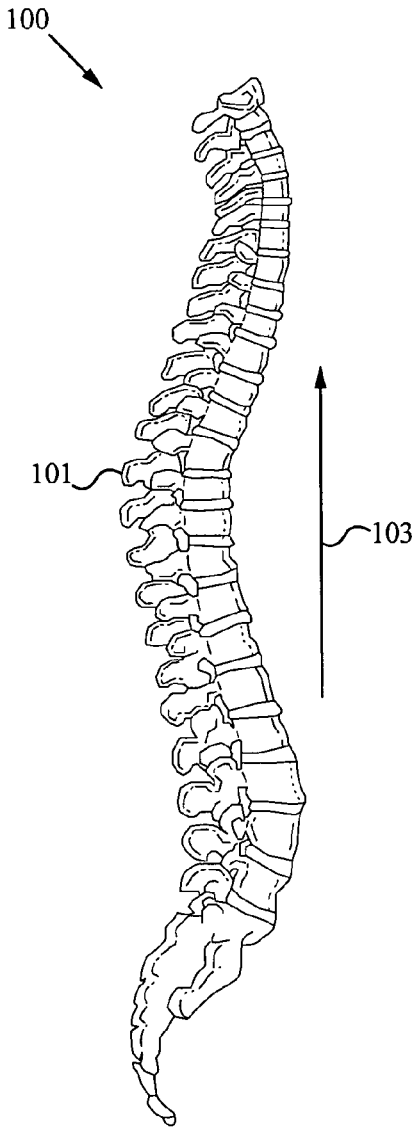
FIGS. 1A-B illustrate views of a spine and a preferred direction for applying traction to the spine, in accordance with the embodiments of the invention.
Figure 1B:
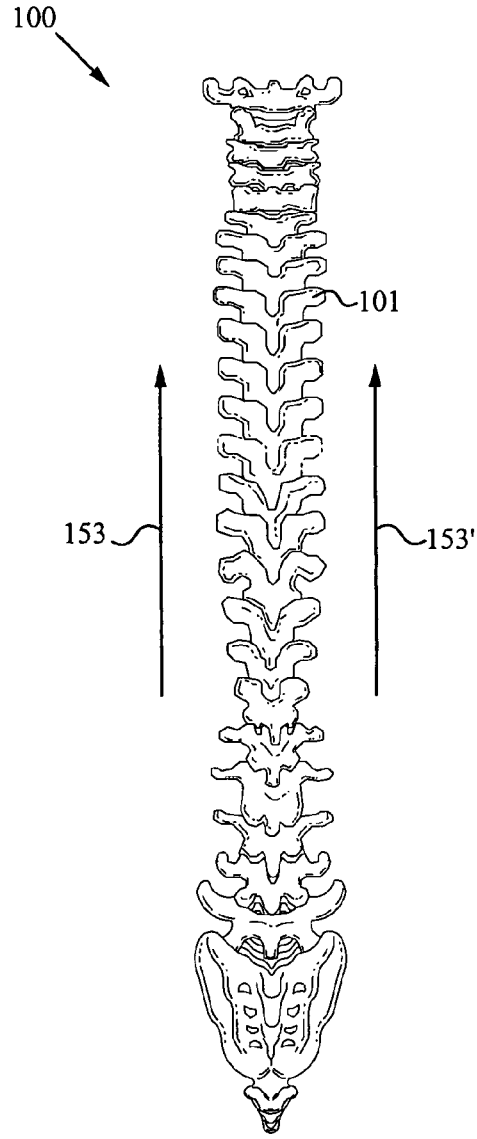

FIG. 1A shows a side view 100 of a spine 101. The arrow 103 indicates an upward direction that traction is applied to the spine 101 to promote good posture, in accordance with the embodiments of the invention. FIG. 1B shows a front view of the spine 101. The arrows 153 and 153' indicate the upward direction for applying traction to opposed sides of the spine 101 in order to promote good posture, in accordance with the preferred embodiments of the invention.

FIG. 2 A shows a cushion apparatus 200 with a plurality of protruding traction pads 203 that protrude from and are attached to a cushion body 207. The cushion body 207 can include a cover 201 and a padding structure 202.

The protruding traction pads 203 are preferably arranged in rows along the cushion body 207, such that protruding traction pads 203 are positioned along opposed sides of a user's spine, as indicated by 215, when the user rests his or her back against the cushion apparatus 200. The protruding traction pads 203 provide an upward force along the opposed sides of the user's spine 215 and thus help to promote good posture.

The cover 201 can be formed from any suitable material or combination of materials including synthetic or natural materials. Preferably, the cover 201 is formed from a woven material, such as nylon, cotton, wool and the like. In accordance with the embodiments of the invention, the cover 201 is used to encase the padding structure 202. The padding structure 202 can be formed from any suitable compressible material or combination of materials, such as a foam material, a batting material, or un-woven cotton. The padding structure 202 can also be formed in layers 204 and 205 or have regions of different materials that each has different physical properties, such as hardness and compressibility.

Figure 2A:
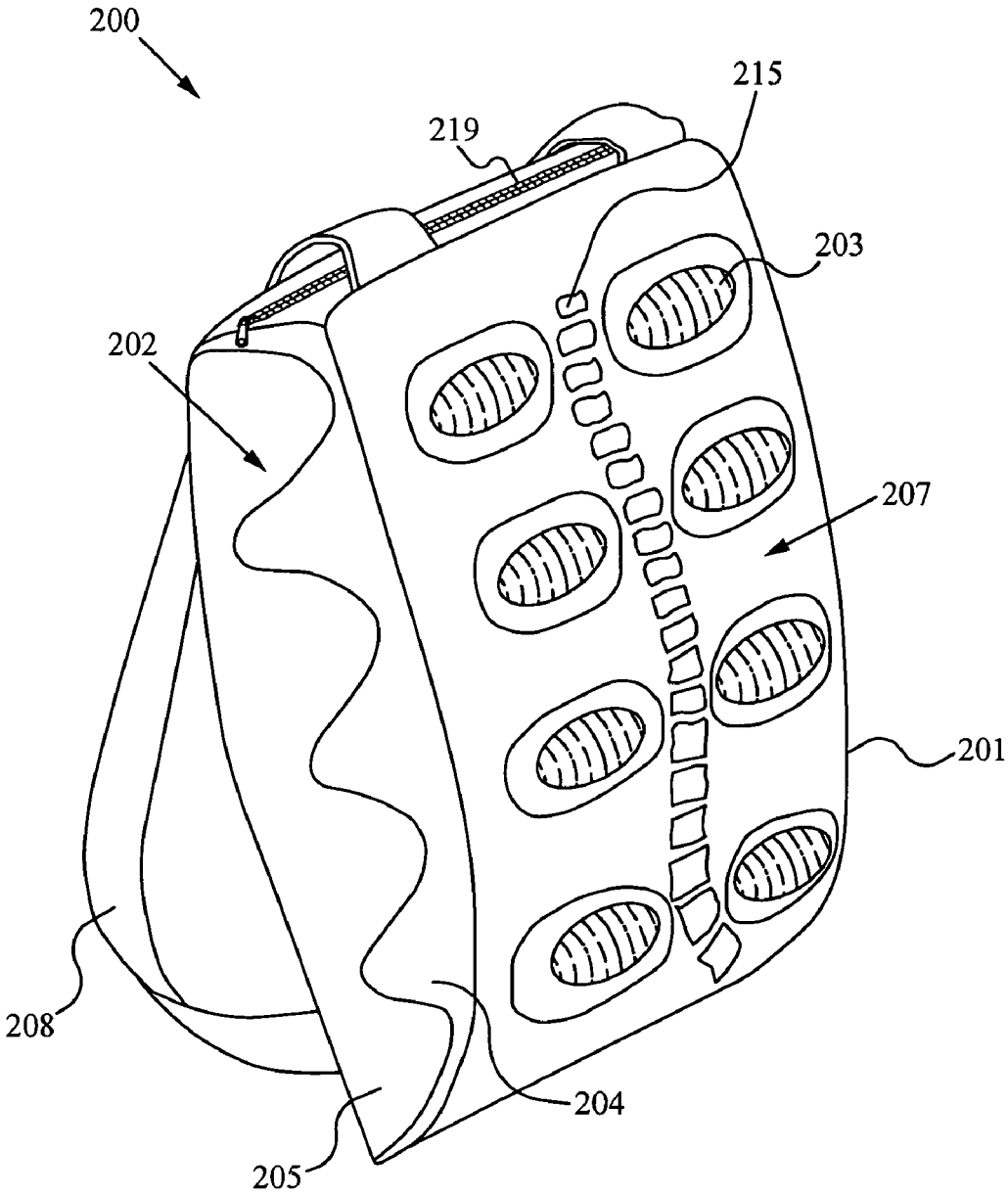
FIG. 2A illustrates a traction cushion structure, in accordance with the embodiments of the invention.

Still referring to FIG. 2A, the cover 201 can be fashioned with a zipper 219 or other features that allow the padding structure 202 to be separated from the cover 201. It will be clear to one skilled in the art from the discussion below that the cushion body 207 does not require a separate cover 201 or padding structure 202, and that the cushion body 207 and traction pads 203 can be formed as a single unit or a monolithic unit.

The cushion body 207 can be formed from any suitable material or combination of materials, but the protruding traction pads 203 are preferably formed from a semi-rigid material, such as a plastic or a rubber material.

In accordance with further embodiments of the invention, the cushion apparatus includes an attachment feature 208. The attachment feature 208 is configured to detachably couple the cushion body 207 to an article of furniture (not shown) at a location on the article of furniture that the user typically rests his or her back. For example, the attachment feature 208 detachably couples the cushion apparatus 200 to a backrest of a chair, the backrest of a couch and/or a headboard of a bed. The attachment feature 208 can be any suitable attachment feature or combination of attachment features including, but not limited to, straps, a pocket feature, a strap feature, a hook and loop fabric feature, a suction cup feature and a clip feature.

Figure 2B:
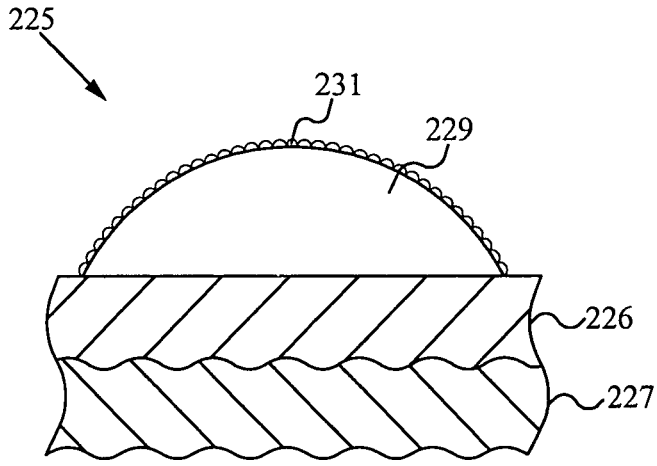
FIG. 2B illustrates a cross sectional view of a traction pad, in accordance with the embodiments of the invention.

Referring now to FIG. 2B, which shows a cross-sectional section view of a protruding traction pad 225, in accordance with the embodiments of the invention. The protruding traction pad 225, such as the protruding traction pads 203 described with reference to FIG. 2A, can be hollow or cup-shaped to provide a cavity 229. The cavity 229 can be filled with air, gas, liquid, or gel to control the hardness or compressibility of the protruding traction pad 225. Alternatively, the protruding traction pad 225 can be formed as a solid and/or porous structure. The traction pad 225 can be attached to a surface of the cushion body 207 (FIG. 2A) through, for example, the cover 201 of the cushion body 207. In further embodiments of the invention, the traction pad 225 is configured to detachably couple to a portion 227 of the cushion body 207 through attachment features 226 such as hook-and-loop fabric attachment features. Further, a contact surface 231 of the traction pad 225 can be patterned or contoured as shown to enhance traction when contacted with a user's back.

Figure 2C:
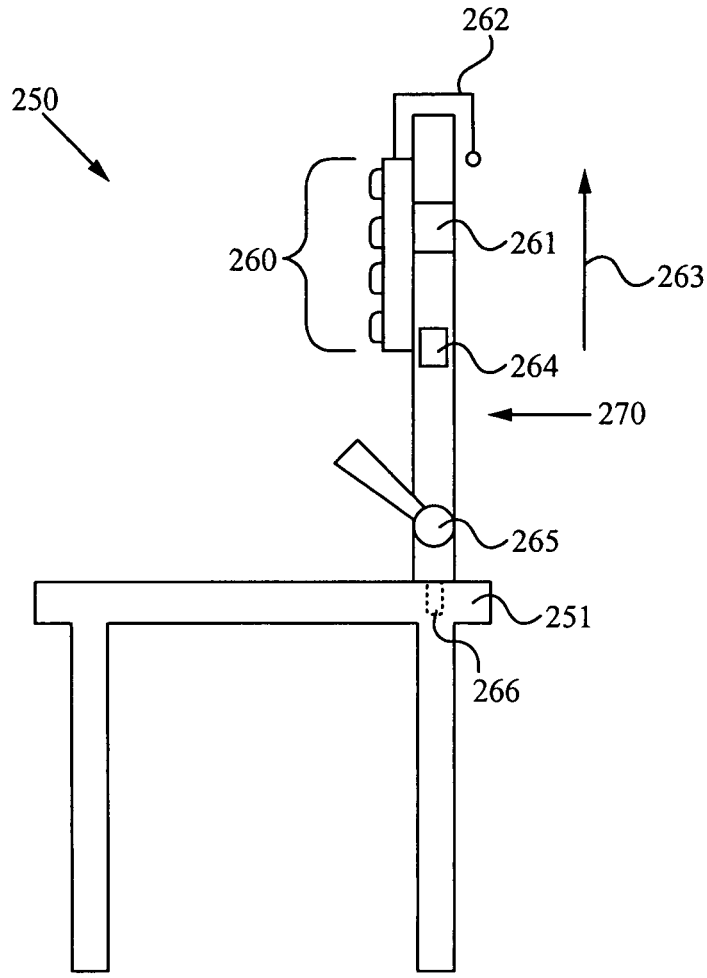
FIG. 2C illustrates an apparatus that includes a back support structure and a cushion structure, in accordance with the embodiments of the invention.

Referring now to FIG. 2C, in accordance with the embodiments of the invention, the apparatus 250 includes a back support structure 270 and a cushion apparatus 260, such as described above. The back support structure 270 can be configured to attach to a seat 251, chair or other article of furniture, through any suitable mechanism 266 including, but not limited to, pins, screws, poles, clamps and hinges. Also the cushion apparatus 260 can be configured to attach to the back support structure 270 using any suitable attachment means 262, such as described above.

In accordance with this embodiment, the apparatus 250 can also include a mechanism 261 configured to move the cushion apparatus 260 a distance in a first direction 263 relative to the back support structure 270 in response to moving the back support 270 in a second direction or in response to moving a lever mechanism 265.

The apparatus 250 can also include a control feature 264 that allows the distance that the cushion structure 260 is moved relative to the back support structure 270 to be adjusted or selected. In accordance with the embodiment of the invention, the cushion apparatus 260 is moved in the first direction 263 relative to the back support structure 270 or relative to the seat 251 through a ratchet mechanism, such as described below with reference to FIGS. 4A-B.

Figure 3A:
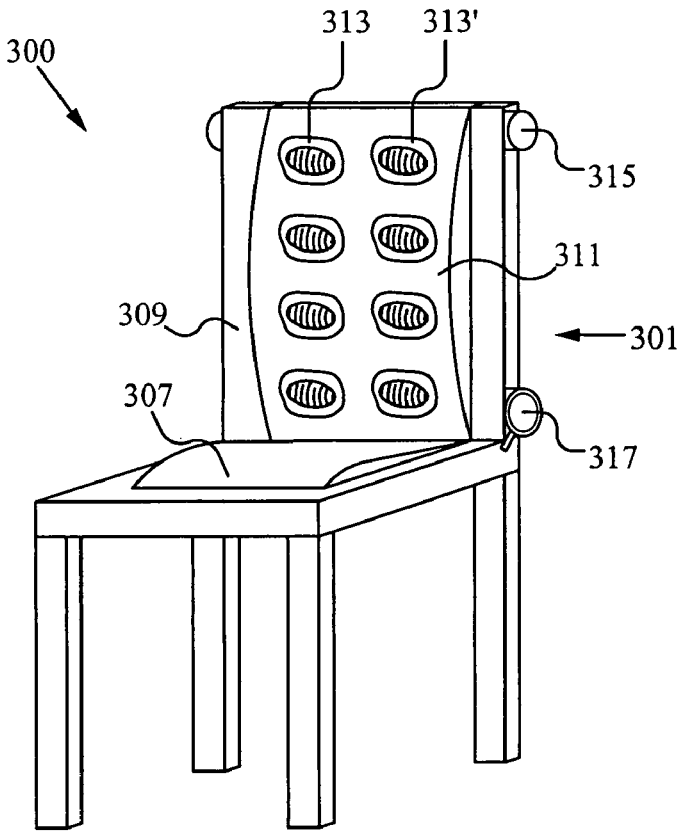
FIGS. 3A-B illustrate a traction chair, in accordance with the invention.
Figure 3B:
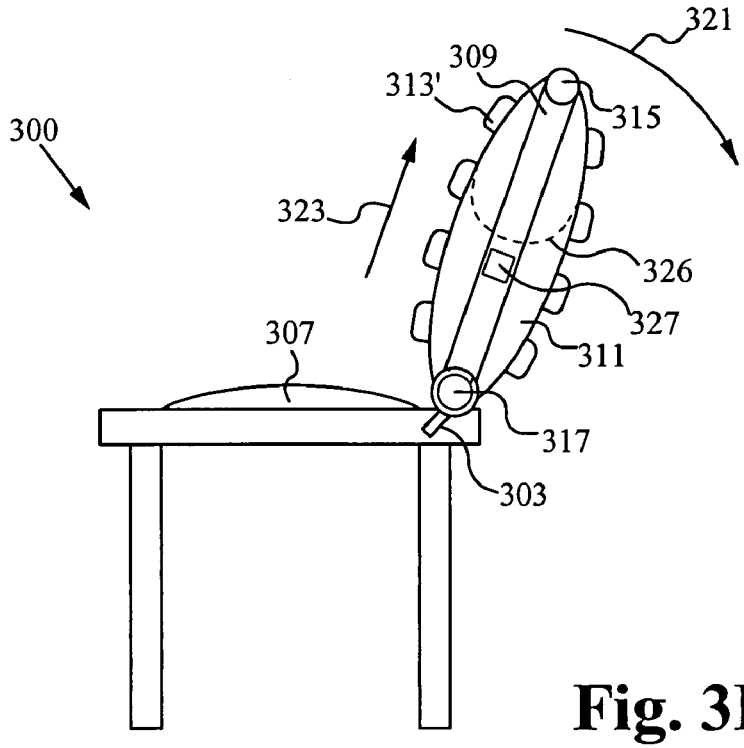

Referring now to FIGS. 3A-B, in accordance with further embodiments of the invention an article of furniture 300 includes a built-in ergonomic cushion apparatus 301, similar to that described above. The article of furniture 300 can be a chair, a bed or a couch, to name only a few possible articles of furniture. Preferably, the article of furniture is 300 is a chair for home or office use and includes a seat portion 307 and a backrest portion 309. Attached to or built into the backrest portion 309 is a cushion structure 311 that is coupled to a mechanism 317. The mechanism 317 is preferably a ratchet mechanism configured to move a front portion of the cushion structure 311 in an upward direction 323 relative to the seat 307 when the backrest portion 309 is moved in a reclining direction or with a reclining motion 321 relative to the seat 307. Alternatively, the chair 300 is equipped with a lever structure (not shown) that can be pulled to move the cushion structure 311, such as described above.

The cushion structure 311 includes a plurality of protruding traction pads 313 and 313' for providing a force along opposed sides of a user's spine as the user's back is in contact with the cushion structure 311, such as described above. In accordance with the embodiments of the invention, the cushion structure 311 is fashioned into a belt that rotates around two or more rollers or pulleys or clutch pulleys 315 and 317 to move the front portion of the belt-shaped cushion structure 311 in the upward direction 323 a distance along the backrest 309. The belt is coupled to a ratchet mechanism 303, such that the front portion of belt or cushion structure 311 is moved in the upward direction 323 the distance along the backrest 309 each time that the backrest 309 of the chair 300 is moved in the reclining direction 321 relative to the seat 307. In still further embodiments of the invention, the traction pads 313 and 313' and/or a cushion cover (not shown) with the traction pads 313 and 313' thereon is detachably coupled to the belt, through, for example, snaps, clips, hook-and-loop fabric fasteners or any other suitable attachment means.

The chair 300 can further include any number of controls or adjustment features 327. For example, the chair 300 can be equipped with a control to adjust the distance that the cushion structure 311 is moved in the upward direction 323 along the backrest 309 each time that the backrest 309 is moved in the reclining direction 321. The built-in ergonomic cushion apparatus 301 can be any size relative to the backrest 309. For example, the cushion structure 311 or belt can be made to span a smaller portion of the backrest 309 as indicated by the dotted line 326.

Figure 4:
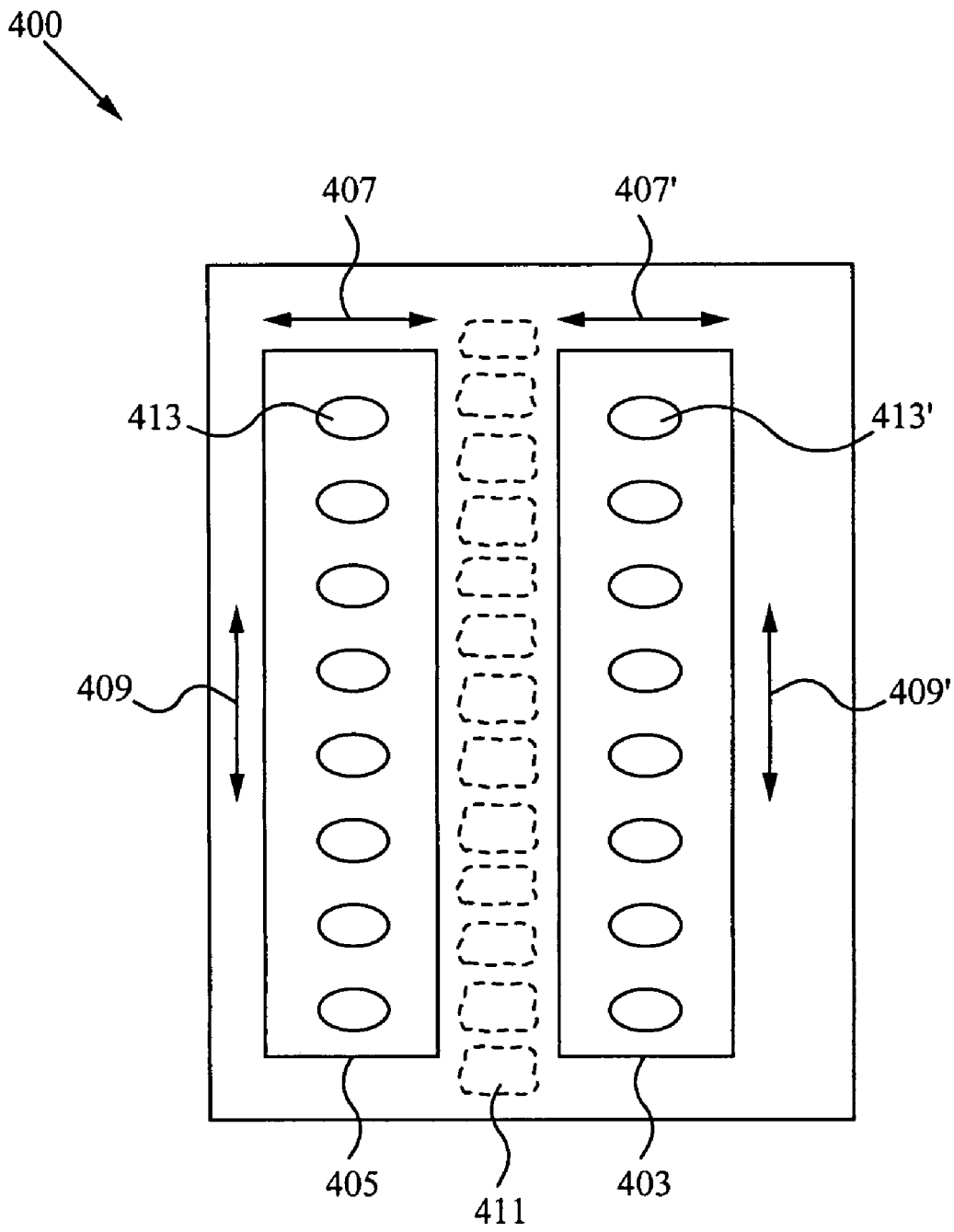
FIG. 4 illustrates an ergonomic traction system with multiple traction regions, in accordance with further embodiments of the invention.

FIG. 4 shows an ergonomic traction system 400 that has multiple traction regions 405 and 403, in accordance with further embodiments of the invention. The ergonomic traction system 400 can be configured to attach to an article of furniture or, alternatively, the ergonomic traction system 400 can be built into the article of furniture, such as described above.

In accordance with the embodiments of the invention, each of the traction regions 405 and 403 includes a set of protruding traction pads 413 and 413', respectively, such as described with reference to FIGS. 2A-B. The traction regions 405 and 403 can each be configured to move in one or more directions 407/409 and 407'/409' with a user's back positioned such that his or her spinal region 411 is located between the traction regions 405 and 403. The traction regions 405 and 403 can be configured to move separately or cooperatively through any suitable mechanism (not shown) including, but not limited to, a ratchet mechanism described above with reference to FIGS. 3A-B. The traction regions 405 and 403 can each include a belt-shaped cushion structure that rotates a distance in one or more directions 407/409 and 407'/409' automatically in response to a user's voluntary or involuntary movements while the user's back is in contact with the traction regions 405 and 403.

Figure 5A:
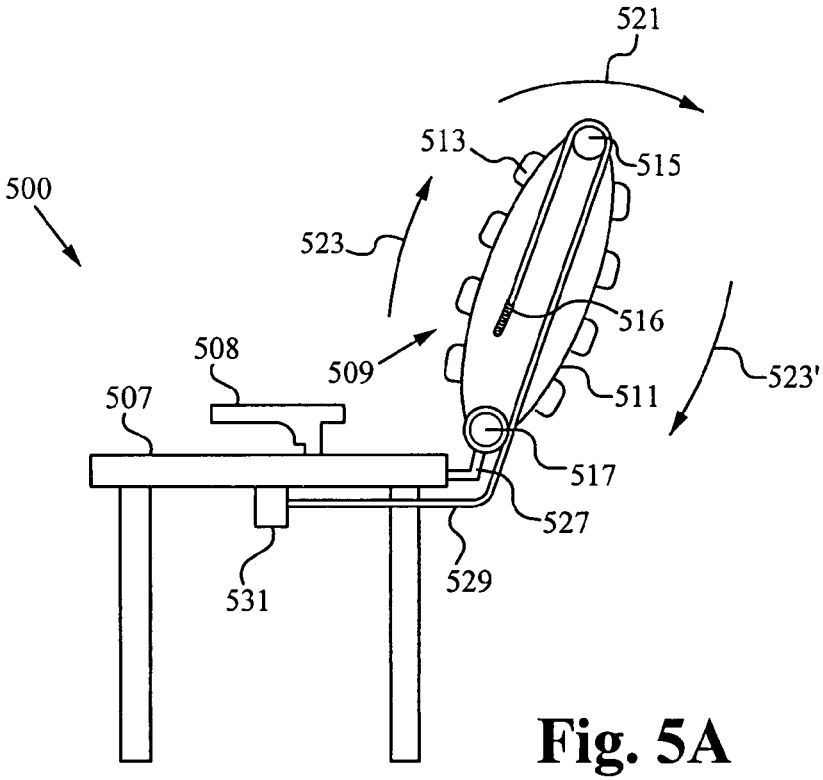
FIGS. 5A-B illustrate a traction chair with a cable mechanism, in accordance with a preferred embodiment of the invention.
Figure 5B:
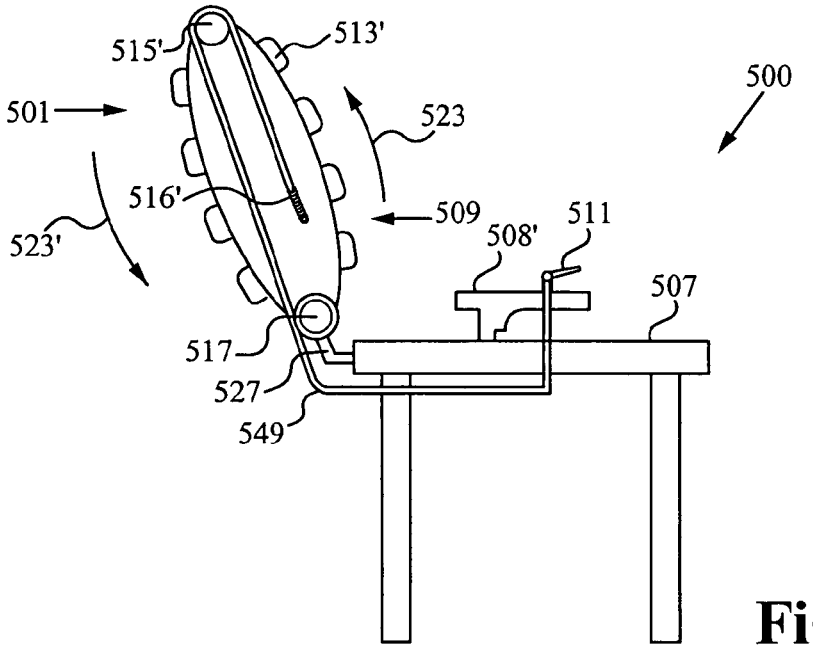

Referring now to FIGS. 5A-B, in accordance with still further embodiments of the invention a chair 500 includes a built-in ergonomic cushion apparatus 501. The chair 500 includes a seat portion 507 and a backrest portion 509. The seat portion 507 and the backrest portion 509 are coupled through any suitable mechanism 527 such as brackets that allow position and height the backrest portion 509 to be adjusted relative to the seat portion 507. The mechanism 527 can also include springs or other features which cause the backrest portion 509 to automatically return to an upright position in the absence of an applied force to move the backrest portion 509 in a reclining direction, as indicated the arrow 521. As shown, the chair 500 can also include arm rests 508 and 508'.

Attached to, or built into, the backrest portion 509 is a belt-shaped cushion structure 511 that is configured to rotate around roller assemblies 515, 515' and 517, as indicated by arrows 523 and 523'. Top roller assemblies 515 and 515' are preferably clutch pulley roller assemblies that allow the belt-shaped cushion structure 511 to only rotate in the direction indicated by the arrows 523 and 523'. By rotating belt-shaped cushion structure 511 in the direction indicated by the arrows 523 and 523, a front portion of the belt-shaped cushion structure 511 and protruding traction pads 513 and 513' attached thereto are moved in an upward direction relative to the seat portion 507.

In accordance with the embodiments of the invention, the chair 500 includes a first cable assembly 529 that is attached to a fixed spring assembly 516 and a portion of the chair 500. A cable from the first cable assembly 529 wraps around the clutch pulley roller assembly 515 as shown, such that the clutch pulley roller assembly 515 is rotated when the back rest portion 509 of the chair is moved in the reclining direction, as indicated by the arrow 521. Rotation of the clutch pulley roller assembly 515 in turn rotates the belt-shaped cushion structure 511 in the rotational direction, indicated by the arrows 523 and 523' and thus moves the front portion of the belt-shaped cushion structure 511 and protruding traction pads 513 and 513' attached thereto in an upward direction relative to the seat portion 507. The first cable assembly 529 can be coupled to the portion of the chair 500 through an adjustment feature 531 that is configured to adjust a length of the cable in the first cable assembly 529 and, thereby, adjust the distance that front portion of the belt-shaped cushion structure 511 and protruding traction pads 513 and 513' are moved each time the backrest portion 509 is moved in the reclining direction 521.

In accordance with the embodiments of the invention, the chair 500 also includes a second cable assembly 549 that is attached to a fixed spring assembly 516' and the arm rest 508' of the chair 500 through a handle or lever assembly 521. The handle or lever assembly 521 is configured to pull or retract cable from the second cable assembly 549, when the handle or lever assembly 521 is manually moved. The cable from the second cable assembly 549 wraps around the clutch pulley roller assembly 515' as shown, such that the clutch pulley roller assembly 515' is rotated when the handle or lever assembly 521 is manually moved. Rotation of the clutch pulley roller assembly 515' in turn rotates the belt-shaped cushion structure 511 in the rotational direction, indicated by the arrows 523 and 523' and thus moves the front portion of the belt-shaped cushion structure 511 and protruding traction pads 513 and 513' attached thereto in an upward direction relative to the seat portion 507. The handle or lever assembly 521 can include controls or adjustment features to control the distance that front portion of the belt-shaped cushion structure 511 and protruding traction pad 513 and 513' are moved when the handle or lever assembly 521 is manually moved.

In yet further embodiments, a cushion structure, such as described above, is built into a back portion of a rocking chair. The cushion structure is coupled to a mechanism configured to move a front portion of the cushion structure in an upward direction relative to the seat in response to rocking the rocking chair with a backward and/or forward motion. The rocking chair can include one or more levers or switches positioned under a rocker portion of the rocking chair. The one or more levers or switches are actuated each time the one or more levers or switches strike the ground as the rocking chair is rocked with the backward and/or forward motion. Alternatively, the rocking chair can include one or more hinged counterweights that remain substantially steady and ratchet or actuate the upward movement of the front portion of the cushion structure each time the rocking chair rocks relative to the one or more counterweights.

The present invention has been described in terms of specific embodiments incorporating details to facilitate the understanding of the principles of construction and operation of the invention. As such, references, herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. An apparatus comprising;

a) a cushion structure comprising a cushion body;

b) rows of traction pads coupled to the cushion body, wherein the traction pads are positionable with contact surfaces along opposed sides of a spine of a user;

c) means for securely attaching the cushion structure to a backrest portion of a chair; and d) a mechanism coupled to the backrest portion of the chair, wherein the mechanism is configured to automatically move the cushion structure a distance along the backrest portion of the chair to an upward position each time that the backrest portion of the chair is moved from a rest position to a reclining position relative to a seat and wherein the cushion structure remains in the upward position. when the backrest portion of the chair is returned to the rest position.

2. The apparatus of claim 1, wherein the protruding traction pads are formed from a semi-rigid rubber material and the cushion structure further includes a padding structure formed from a compressible material.

3. The apparatus of claim 2, wherein the cushion structure further includes a removable cover that encases the padding structure and wherein the protruding traction pads are formed on the removable cover.

4. The apparatus of claim 1, wherein the means for attaching the cushion structure to the backrest portion of the chair includes one or more of a strap feature, a pocket feature, hook and loop fabric, a suction cup and a clip feature.

5. The apparatus of claim 1, further including a control for adjusting the distance that the cushion structure is moved along the backrest portion of the chair to an upward position.

6. An article of furniture comprising:

a) a seat;

b) a back support c) built-in ergonomic back support system comprising:

I) a cushion structure; and ii) a mechanism coupled to the back support and the cushion structure, such that the cushion structure is configured to move in an upward direction a distance along the back support to an upward position each time that the back support is moved from a rest position to a reclining position relative to the seat and wherein the cushion structure remains in the upward position, when the back support is returned to the rest position.

7. The article of claim 6, wherein the cushion structure comprises a plurality of protruding traction pads for providing a force along opposed sides of a spine of a user as the user's back is in contact with the cushion structure.

8. The article of claim 6, wherein cushion structure includes a belt that rotates around two or more rollers or pulleys to move a front portion of the cushion structure in the upward direction the distance along the back support.

9. The article of claim 8, wherein the cushion structure includes a cover that is detachably coupled to the belt.

10. The article of claim 6, further comprising an adjustment means to adjust the distance that the cushion structure is moved in the upward direction along the back support, when the back support is moved to the reclining position.

11. The article of claim 6, wherein the mechanism is a ratchet mechanism that ratchets the cushion structure to move in the upward direction the distance along the back support, each time that the backrest is moved in the reclining direction.

12. The article of claim 6, further including a control for adjusting the distance that the cushion structure is moved in the upward direction the distance along the back support, when the back support is moved in the reclining direction.

13. A system comprising a support surface with one or more movable traction regions that move in a first direction for a selectable distance to a new position in response to moving a portion of the support surface from a rest position in a second direction that is different from the first direction, wherein the one or more regions have protruding traction pads for positioning along opposed sides of a spine of a user with the user's back in contact with the one or more traction regions and wherein the movable traction regions remain in the new position when the support surface is returned to the rest position.

14. The system of claim 13, wherein the support surface includes a belt that rotates to move the one or more traction regions the selectable distance.

15. The system of claim 14, wherein the traction pads protrude from a cushion structure that is detachably coupled to the belt.

16. The system of claim 14, further comprising a ratchet mechanism coupled to the belt.

17. A system comprising:

a) a seat;

b) a back support with a cushion structure and a mechanism coupled to the back support and the cushion structure, wherein the mechanism is configured to ratchet a contact surface of the cushion structure to a upward location along the back support each time the back support is moved for a resting position to a reclining position and wherein the surface remains in the upward location when the back support is returned to the resting position.

18. The system of claim 17, wherein the surface of the cushion structure includes traction pads with protruding contact surfaces for positioning along opposed sides of a spine of a user as the user's back is in contact with the back support.

* * * * *